US006308954B1

(12) United States Patent
Breeler

(10) Patent No.: US 6,308,954 B1
(45) Date of Patent: Oct. 30, 2001

(54) INTEGRATED CROSSWORD AND CIRCLE-A-WORD PUZZLE

(76) Inventor: George L Breeler, 62 Smithridge Park, Reno, NV (US) 89502

( * ) Notice: Subject to any disclaimer, the term of this patent is extended or adjusted under 35 U.S.C. 154(b) by 0 days.

(21) Appl. No.: 09/608,953

(22) Filed: Jun. 30, 2000

Related U.S. Application Data

(60) Provisional application No. 60/142,187, filed on Jul. 1, 1999.

(51) Int. Cl.[7] ..... A63F 9/00
(52) U.S. Cl. ..... 273/153 R; 273/272
(58) Field of Search ..... 273/240, 272, 273/273, 299, 153 R; 283/45, 46, 49, 5, 117

(56) References Cited

U.S. PATENT DOCUMENTS

| | | | | |
|---|---|---|---|---|
| 1,625,218 | * | 4/1927 | Lundy | 273/153 R |
| 1,642,424 | * | 9/1927 | Massey | 273/153 R |
| 2,050,498 | * | 8/1936 | Mitchell | 273/153 R |
| 2,055,159 | * | 9/1936 | Scofield | 273/153 R |
| 4,595,203 | * | 6/1986 | DeLano | 273/148 R |
| 5,566,942 | * | 10/1996 | Elum | 273/153 R |

FOREIGN PATENT DOCUMENTS

2117255 * 10/1983 (GB) ..... 273/272

OTHER PUBLICATIONS

Dell, Official Word Search Puzzles, vol. 13, No. 6 (Conn. Dec. 2000) at p. 4, 82, and 108.*

* cited by examiner

*Primary Examiner*—Steven Wong
(74) *Attorney, Agent, or Firm*—David S. Thompson

(57) ABSTRACT

An integrated crossword and circle-a-word puzzle includes a number of open spaces defining an interlocking crossword region and a number of preprinted letters which replace the black squares present in traditional crossword puzzles. The crossword region includes a number of spaces defining at least one across word and one down word. The preprinted letters include a number of circle-a-word preprinted letters and circle-a-word camouflage letters. During the process of solving the puzzle, the circle-a-word words are circled. Circle-a-word words may have one or more circle-a-word preprinted letters and may have one or more circle-a-word spaces within the crossword region. In this circumstance, the letter added to the circle-a-word space adds to the solution of the crossword region. In a preferred version of the puzzle, a number of open spaces within the crossword region are defined by an indicator to be unscramble-a-word spaces. When all of the unscramble-a-word spaces are filled with letters, the unscramble-a-word letters which belong in these spaces may be unscrambled into an unscramble-a-word solution.

10 Claims, 10 Drawing Sheets

| | | | | | | | | | | | | | | | | | |
|---|---|---|---|---|---|---|---|---|---|---|---|---|---|---|---|---|---|
| A | S | D | F | G | H | J | K | L | W | Q | R | T | U | V | I | O | P |
| D | S | N | E | W | A | M | N | P | U | Z | Z | L | E | B | C | X | Z |
| F | G | J | K | L | Q | W | E | R | H | E | T | Y | U | I | O | P | A |
| F | D | S | A | L | M | N | P | B | 1 | K | 2 | 3 | 4 | 5 | Y | B | S |
| G | H | J | K | A | L | W | I | Q | | O | 6 | | | | R | C | D |
| O | I | U | E | W | Y | 7 | | | | 8 | | | | | E | X | F |
| P | A | S | D | N | F | G | A | H | 9 | | | L | O | N | I | Z | G |
| Y | T | R | U | M | A | T | R | 10 | | | | | | | S | L | H |
| U | I | O | Q | O | W | L | 11 | | | | L | F | K | J | N | K | J |
| P | A | S | D | W | F | 12 | | | | | G | F | H | J | O | J | K |
| M | N | B | V | E | C | 13 | | | | X | Z | E | L | K | I | H | L |
| A | P | 14 | | | 15 | | | | A | S | D | C | F | G | L | G | W |
| S | O | E | R | O | 16 | | | W | S | L | K | T | J | H | L | F | Q |
| D | I | 17 | 18 | | | | | | | | T | I | Z | X | I | D | E |
| F | U | 19 | | | | L | | B | I | E | B | O | S | D | M | S | R |
| W | Y | 20 | | | | B | | N | P | M | A | N | S | D | F | A | T |
| Q | T | A | G | D | F | D | S | A | L | K | S | H | G | P | O | I | Y |
| E | R | R | D | O | E | Y | O | U | B | L | I | K | E | O | I | T | U |

20

140

80

141

31

CIRCLE-A-WORD

| | |
|---|---|
| DO | PLANE |
| YOU | OBIE |
| LIKE | COKE |
| NEW | TAR |
| PUZZLE | SIDE |
| MILLIONS | IT |
| NEED | SNIP |
| TREND | GALLON |
| PITA | LAWNMOWER |
| AFFECTION | |

UNSCRAMBLE-A-WORD

_ _ _ _ _ _ _

CLUE:

TRAIN OF THOUGHT

_ _ _ _ _ _ _

62

10

ACROSS 2 oohs and ___
6 "no" in Russian
7 assailants
9 liquid measure (abbr.)
10 makes beloved
11 actor ___ Sharif
12 backbone
13 hide
14 messenger of gods
16 Mt. in Asia Minor
17 tumbler's feat
19 small dagger
20 layer

61

60

DOWN 1 not active
2 leg joint
3 sailor's "yes"
4 she, object form
5 Spokane Transit System
8 core group
10 ___ Dickinson
11 phone company employee
12 potatoes
15 apple drink
17 president before DDE
18 blackbird

FIG. 1

| | | | | | | | | | | | | | | | | | |
|---|---|---|---|---|---|---|---|---|---|---|---|---|---|---|---|---|---|
| A | S | D | F | G | H | J | K | L | W | Q | R | T | U | V | I | O | P |
| D | S | N | E | W | A | M | N | P | U | Z | Z | L | E | B | C | X | Z |
| F | G | J | K | L | Q | W | E | R | H | E | T | Y | U | I | O | P | A |
| F | D | S | A | L | M | N | P | B | 1 s | K | 2 a | 3 a | 4 h | 5 s | Y | B | S |
| G | H | J | K | A | L | W | I | Q | t | O | 6 n | y | e | t | R | C | D |
| O | I | U | E | W | Y | 7 a | t | t | a | 8 c | k | e | r | s | E | X | F |
| P | A | S | D | N | F | G | A | H | 9 g | a | l | L | O | N | I | Z | G |
| Y | T | R | U | M | A | T | R | 10 e | n | d | e | a | r | s | S | L | H |
| U | I | O | Q | O | W | L | 11 o | m | a | r | L | F | K | J | N | K | J |
| P | A | S | D | W | F | 12 s | p | i | n | e | G | F | H | J | O | J | K |
| M | N | B | V | E | C | 13 p | e | l | t | X | Z | E | L | K | I | H | L |
| A | P | 14 m | e | r | 15 c | u | r | y | A | S | D | C | F | G | L | G | W |
| S | O | E | R | O | 16 i | d | a | W | S | L | K | T | J | H | L | F | Q |
| D | I | 17 h | 18 a | n | d | s | t | a | n | d | T | I | Z | X | I | D | E |
| F | U | 19 s | n | e | e | L | o | B | I | E | B | O | S | D | M | S | R |
| W | Y | 20 t | i | e | r | B | r | N | P | M | A | N | S | D | F | A | T |
| Q | T | A | G | D | F | D | S | A | L | K | S | H | G | P | O | I | Y |
| E | R | R | D | O | E | Y | O | U | B | L | I | K | E | O | I | T | U |

150

ACROSS — 60

2 oohs and ___
6 "no" in Russian
7 assailants
9 liquid measure (abbr.)
10 makes beloved
11 actor ___ Sharif
12 backbone
13 hide
14 messenger of gods
16 Mt. in Asia Minor
17 tumbler's feat
19 small dagger — 61
20 layer

10

DOWN — 62

1 not active
2 leg joint
3 sailor's "yes"
4 she, object form
5 Spokane Transit System
8 core group
10 ___ Dickinson
11 phone company employee
12 potatoes
15 apple drink
17 president before DDE
18 blackbird

CIRCLE-A-WORD — 130

DO
YOU
LIKE
NEW — 131
PUZZLE
MILLIONS
NEED
TREND
PITA
AFFECTION
GALLON
SNIP
PLANE
OBIE
COKE
TAR
SIDE
IT
LAWNMOWER

UNSCRAMBLE-A-WORD

170 — S N D M E I T — 171

CLUE:
TRAIN OF THOUGHT — 160

180 — M I N D S E T

FIG. 6

Circle-a-Word

| | | |
|---|---|---|
| CAT | YEAR | PLUM |
| CHINA | FIDO | KITE |
| PLEA | DOWN | OTIS |
| REPAIR | SNIF | FEAR |
| MEN | SHED | REST |
| NECK | STEP | |
| SARI | TEEN | |
| SANG | OAK | |

130

| | | | | | | | | | | | | | | |
|---|---|---|---|---|---|---|---|---|---|---|---|---|---|---|
| a | c | d | c | A | t | r | a | m | p | A | c | h | a | p |
| s | o | i | l | H | b | l | e | a | r | L | p | i | c | a |
| k | n | e | e | d | i | s | t | r | i | b | u | t | o | r |
| R | E | P | a | i | r | N | n | a | s | a | A | m | r | i |
| h | u | b | r | a | d | i | a | t | o | r | l | e | n | s |
| e | n | e | M | n | s | f | M | R | n | b | a | T | L | K |
| i | c | e | i | n | F | n | e | n | e | E | t | b | s | p |
| d | u | n | c | e | p | o | l | a | r | w | h | i | t | e |
| i | t | s | a | K | o | t | i | s | R | e | s | t | e | r |
| B | E | O | n | f | l | B | S | a | r | i | Y | e | a | r |
| b | o | t | t | l | e | s | a | l | a | r | y | s | k | y |
| u | s | a | I | a | m | i | n | F | i | d | o | W | N | B |
| t | h | i | n | k | i | n | g | s | n | o | w | r | e | d |
| c | e | l | t | A | c | a | s | t | e | P | i | a | g | o |
| h | a | s | h | O | s | i | t | e | s | H | e | d | g | e |

110

80

81

130

120

90

90

100

Circle-a-Word

| | | |
|---|---|---|
| CAT | YEAR | PLUM |
| CHINA | FIDO | KITE |
| PLEA | DOWN | OTIS |
| REPAIR | SNIF | FEAR |
| MEN | SHED | REST |
| NECK | STEP | |
| SARI | TEEN | |
| SANG | OAK | |

131

FIG. 13

INTEGRATED CROSSWORD AND CIRCLE-A-WORD PUZZLE

CROSS-REFERENCES

This application is a continuation in part of provisional application Ser. No. 60/142,187, filed Jul. 1, 1999 by the same inventor.

BACKGROUND

Crossword puzzles are well-known and have been popular for many years. The popularity of such puzzles is based in large part on the interlocking nature of the words. That is, many of the letters for an "across" word are shared in common by one or more "down" words, and vice versa. As a result, each word that is discovered typically results in additional clues for the words yet to be discovered. A talented crossword puzzle enthusiast is therefore able to attack the puzzle by first obtaining easily solved words, which in turn result in enough clues so that words of greater difficulty are obtainable. As the number of words solved increases, the number of clues also increases, allowing the complete puzzle to be solved.

However, not all puzzle enthusiasts are talented enough to be able to easily solve a sufficiently large core portion of the puzzle. Unable to obtain such a foothold on the puzzle, such individuals do not reach the stage in the solution that sufficient additional clues are available. As a result, the puzzle is not solvable, and is therefore not enjoyable.

For the foregoing reasons, there is a need for an improved crossword puzzle that can be played generally according to the rules of crossword puzzles. The improved crossword puzzle must provide additional clues, so that those individuals who are not able to solve conventional crossword puzzles will be able to solve the puzzle. However, the clues should be sufficiently easy to ignore, so that individuals for whom the solution is more easily determined should be able to work the puzzle without the additional clues, if desired.

SUMMARY

The present invention is directed to a puzzle that satisfies the above needs. A novel integrated crossword and circle-a-word puzzle is disclosed that provides the advantages of a crossword puzzle, the advantages of a circle-a-word puzzle and additional advantages related to the combination of the two. Further, the puzzle also provides the advantage of an unscramble-a-word puzzle embedded within the combined crossword and circle-a-word puzzle.

A preferred version of the puzzle provides an interlocking crossword region similar to a crossword puzzle. However, the black squares in well-known crossword puzzles are replaced with preprinted letters. Hidden within the preprinted letters are letters organized to form circle-a-word words that may be arranged so that consecutive letters are arranged in the up, down, left, right, or ascending or descending diagonal directions. Significantly, some of the circle-a-word words intersect with one or more of the blank spaces of the interlocking crossword region. The result is that with one or more letters missing from the circle-a-word word (due to the intersection with the crossword region) the circle-a-word words are more difficult to find. However, each such circle-a-word word, once found, allows one or more letters of the crossword region to be discovered. In a further feature optionally contained by the puzzle, a number of spaces within the crossword region are circled. When the proper letters contained within these circled spaces are discovered, they may be unscrambled (i.e. their order rearranged) until the letters form one or more words representing the final solution of the puzzle.

A preferred version of the puzzle 10 of the present invention provides some or all of the following structures.

(A) An array 20, including:

(a) An interlocking crossword region 30, having spaces 31 for letters allowing the formation of across and down crossword words.

(b) A circle-a-word region 70, formed in part from preprinted letters 80 in array locations not occupied by the interlocking crossword region. The preprinted letters may include some of each of the following.

(i) Circle-a-word preprinted letters 90 may be distributed in some spaces not part of the interlocking crossword region.

(ii) Circle-a-word camouflage letters 120 are typically distributed in some of the spaces of the array not part of the interlocking crossword region, and tend to hide (camouflage) the circle-a-word letters.

(c) A region of intersection 110 between the interlocking crossword region 30 and the circle-a-word region 70, including at least one circle-a-word space 111 embedded within the interlocking crossword region. Thus, where a circle-a-word word 100 extends into the crossword region, one or more letters of the circle-a-word word are not preprinted, thereby making the circle-a-word word more difficult to find. However, once found, the circle-a-word spaces 111 defined in the crossword region become known.

(d) Unscramble-a-word spaces 140 may be defined among the spaces in the interlocking crossword region. Typically such unscramble-a-word spaces are defined by a circle 141. When all of the spaces within the interlocking crossword region having such a designation are filled by the player, the letters may be unscrambled to reveal the final solution to the puzzle.

(B) A crossword clue section 60, typically including one clue for each across and each down crossword word.

(C) A circle-a-word clue section 130, each clue being a word associated with one circle-a-word.

(D) An unscramble-a-word clue to aid in the solution of the unscramble-a-word.

(E) An unscramble-a-word solution area 170 defining a location for each letter carried by an unscramble-a-word space.

It is therefore a primary advantage of the present invention to provide a novel integrated crossword and circle-a-word puzzle that provides additional clues to puzzle enthusiasts who are not sufficiently skilled to solve crossword puzzles without the clues.

Another advantage of the present invention is to provide a novel integrated crossword and circle-a-word puzzle that has all the advantages of a crossword puzzle, and which can be operated in manner similar to a crossword puzzle by a person not desiring to take advantage of the multiple puzzles present.

Another advantage of the present invention is to provide a novel integrated crossword and circle-a-word puzzle that allows regulation of the level of difficulty by addition of a greater or lesser number of circle-a-word preprinted letters. A greater number of circle-a-word preprinted letters tends to result in a lesser number of across and down words within an interlocking crossword region and also results in a greater number of circle-a-word words providing clues to the crossword region. Both of these factors tend to make the puzzle easier to solve.

Another advantage of the present invention is to provide a novel integrated crossword and circle-a-word puzzle that provides regulation of the level of difficulty by a second means. By varying the degree to which individual circle-a-word words intersect the interlocking crossword region, the degree of difficulty can be varied. For example, where a circle-a-word word has six letters and five of those letters are preprinted and one letter is within the interlocking crossword region, the circle-a-word word is relatively easily found. In contrast, where only two of the six letters of the circle-a-word word are preprinted and four letters are within the interlocking crossword region, the circle-a-word word is relatively more difficult to find; however the value of such a word is greater, since the four letters within the interlocking crossword region add considerably to the solution of the puzzle.

A still further advantage of the present invention is to provide a novel integrated crossword and circle-a-word puzzle that additionally provides a plurality of unscramble-a-word spaces, which when the interlocking crossword region is completed contain unscramble-a-word letters that may be unscrambled into an unscramble-a-word solution.

DRAWINGS

These and other features, aspects, and advantages of the present invention will become better understood with regard to the following description, appended claims, and accompanying drawings where:

FIG. 1 is a view of a version of the puzzle of the invention prior to solution.

FIG. 6 is a view of the puzzle of FIG. 1 after the unscramble-a-word solution has been discovered, thereby completing the puzzle solution.

Figure 8:
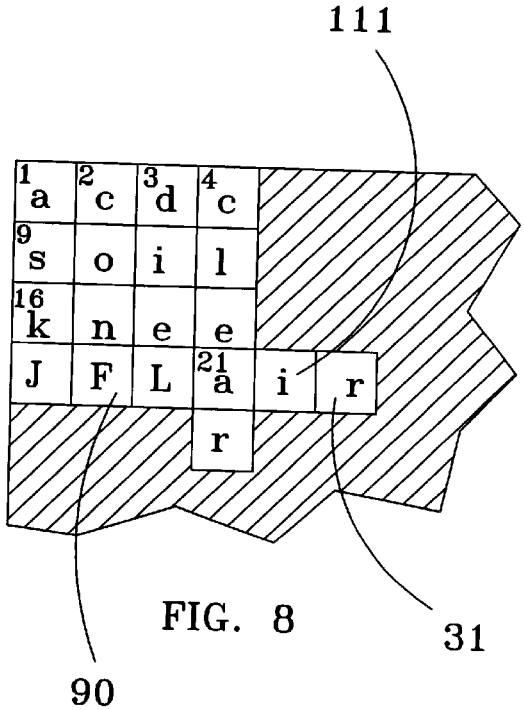
FIG. 8 is a view of a corner of a puzzle similar to that of FIG. 7. However two circle-a-word preprinted letters, the capital "F" and "L" combine with the three circle-a-word spaces, filed with the lower case "a," "i" and "r," thereby spelling the word "flair," and illustrating that the capital "F" and "L" are camouflaged to some degree by the capital "J".
Figure 9:
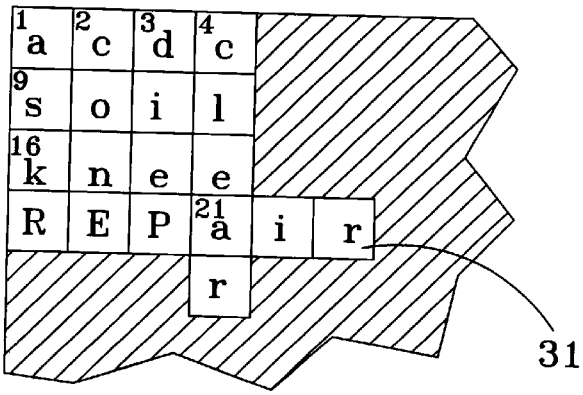

FIG. 9 is a view of a corner of a puzzle similar to that of FIG. 8. However three circle-a-word preprinted letters, the capital "R," "E" and "P" combine with the three circle-a-word spaces, filed with the lower case "a," "i" and "r," thereby spelling the word "repair," and illustrating that the capital "R," "E" and "P" are more easily seen and recognized because they are not camouflaged by nearby preprinted letters.

Figure 7:
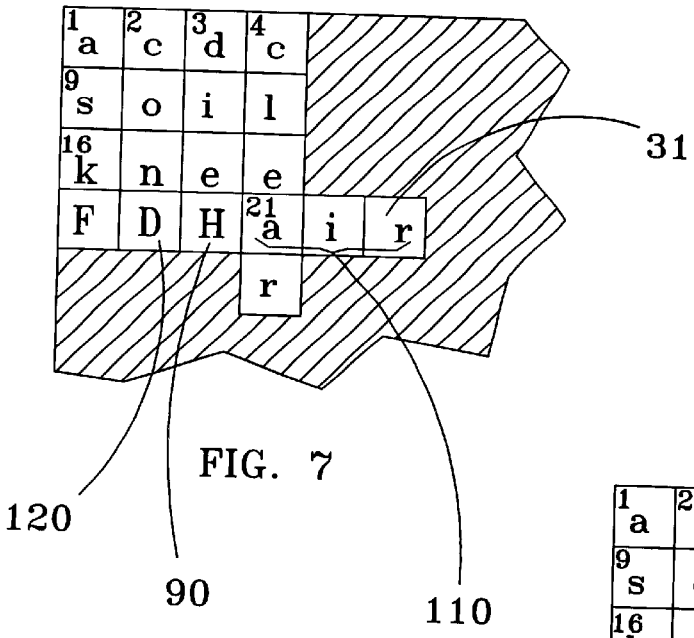
FIG. 7 is a view of a corner of a puzzle, illustrating how one circle-a-word preprinted letter, the capital "H" is associated with three circle-a-word spaces, filed with the lower case "a," "i" and "r," thereby spelling the word "hair," and illustrating that the capital "H" is camouflaged by the capital "F" and "D".
Figure 10:
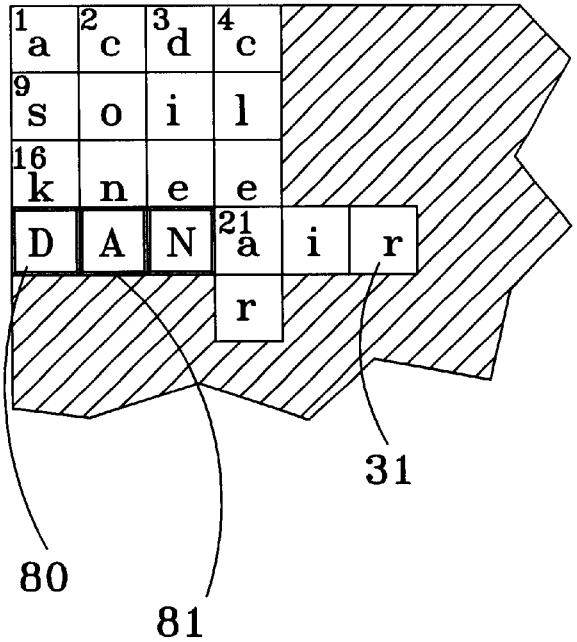

FIG. 10 is a view of a corner of a puzzle similar to that of FIGS. 7 through 9. However, in this instance, three circle-a-word preprinted letters are associated with a single circle-a-word space.

Figure 11:
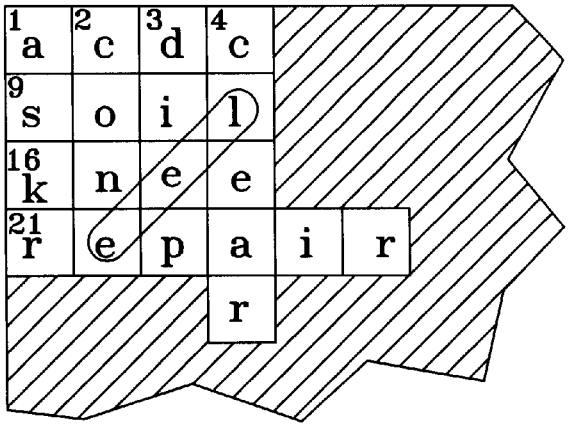

FIG. 11 is a view of a corner of a puzzle in a version of the invention wherein the entire circle-a-word region is contained within the crossword region.

Figure 12:
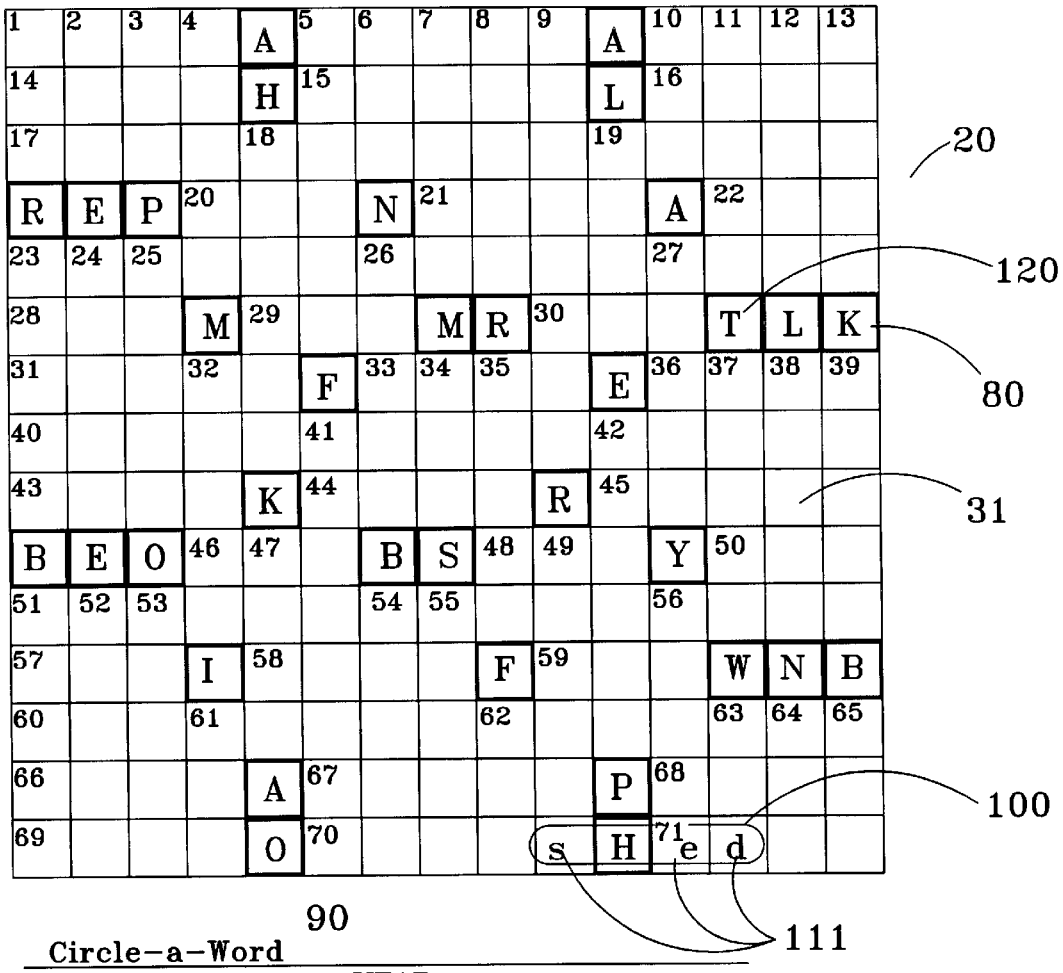

FIG. 12 is a view of the array portion and the circle-a-word clue section of a puzzle with the crossword region not filled out and the circle-a-word words not circled.

FIG. 13 is a view of the puzzle of FIG. 12 having the crossword region filled out and the circle-a-word words circled.

DESCRIPTION

Referring in generally to FIGS. 1 through 10, an example of a puzzle 10 constructed in accordance with the principles of the invention is seen. An array 20 includes a number of open spaces 31 defining an interlocking crossword region 30 and a number of preprinted letters 80. The crossword region includes a number of spaces defining at least one across word sequence of spaces 40 and one down word sequence of spaces 50. The preprinted letters include a number of circle-a-word preprinted letters 90 and circle-a-word camouflage letters 120. During the process of solving the puzzle, the circle-a-word words 90 are circled as they are discovered. Circle-a-word words typically have one or more circle-a-word preprinted letters 100 and typically have one or more circle-a-word spaces 111 within the interlocking crossword region 30. In this circumstance, the letter which goes into the circle-a-word space 111 is then revealed, contributing to the solution of the crossword puzzle and making the solution to the discovery of letters belonging in the crossword region easier. In a preferred version of the puzzle, a number of open spaces 31 within the crossword region 30 are defined to be unscramble-a-word spaces 140. When discovered, the unscramble-a-word letters 150 which belong in these spaces may be unscrambled into an unscramble-a-word solution 180.

Figure 2:
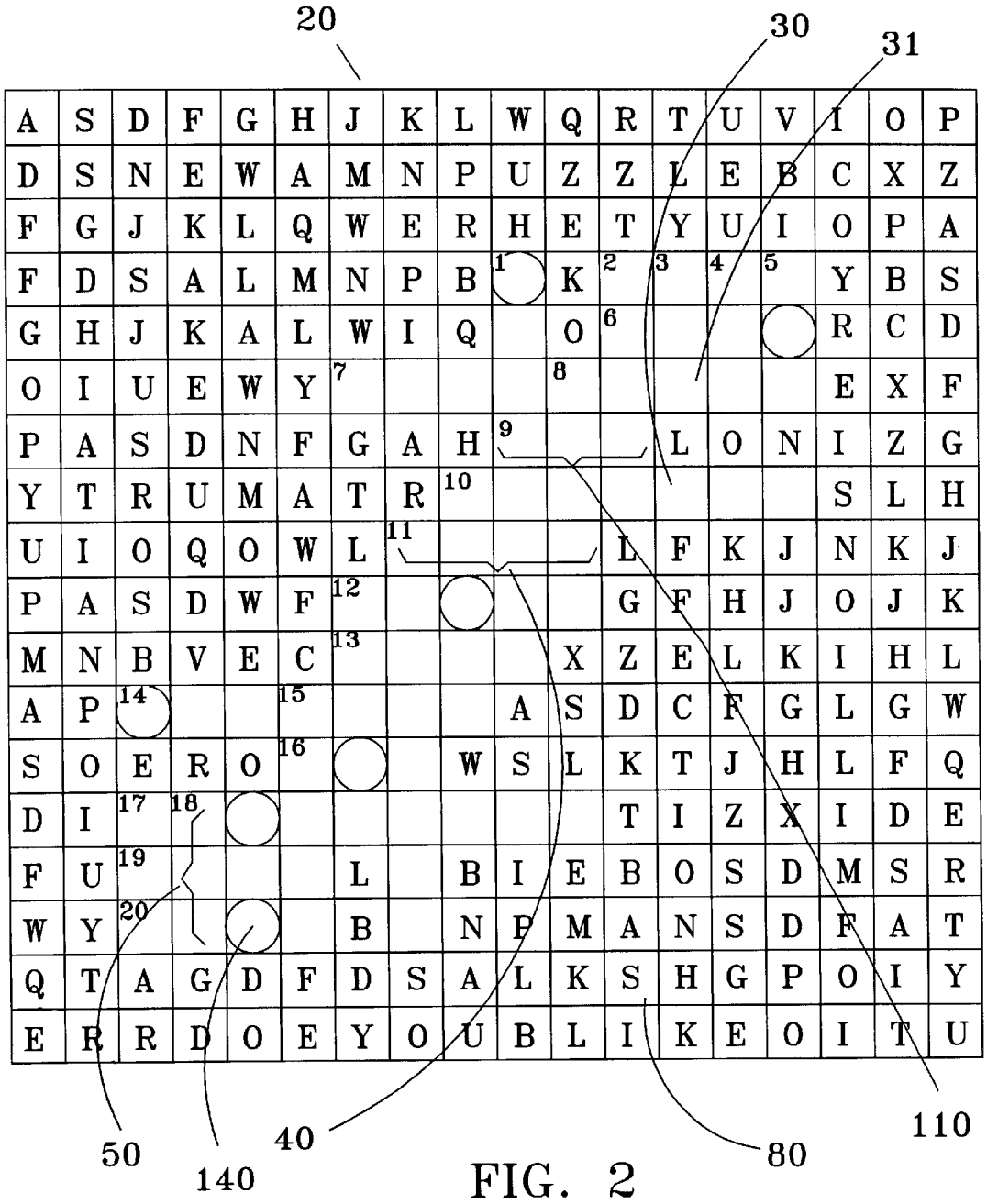
FIG. 2 is an enlarged view of the array of the puzzle of FIG. 1.

As seen particularly in FIG. 2, an array 20 includes a number of open spaces 31 which collectively form a crossword region 30. As is also most easily seen in FIG. 2, the array 20 also includes a number of preprinted letters 80.

Comparing the array 20 to a traditional crossword puzzle, it can be seen that both provide a crossword region comprising a number of open spaces which are organized into across and down words. However, the array 20 of FIG. 2 also illustrates that the instant puzzle has replaced the black square which are present in traditional crossword puzzles with preprinted letters 80. As is well-known, the black squares in a traditional crossword puzzle are locations which are not part of any down or any across word. Similarly, the preprinted letters are not a part of either an across or down word. The preprinted letters 80 may be enclosed in a box 81.

As seen in FIG. 2, an interlocking crossword region 30 includes a plurality of spaces 31. The spaces are organized in a manner which forms at least one across word space 40 and at least one down word space 50. In a preferred embodiment, a number of across and down word spaces would be provided, as is well-known in current crossword puzzles. Each across or down word spaces 40, 50 would typically contain several spaces 31 within which individual letters corresponding to an across word 41 or a down word 51 are written during the course of the solution to the puzzle. Thus, the number of letters in an across word or a down word is equal to the number of spaces 31 in the associated across or down word spaces 40, 50. Also, each space 31 might be included within an across word space 40, a down word space 50, or both. The number of spaces 31 which are contained in both an across word space and a down word space results in the "interlocking" nature of the crossword puzzle. This feature is to a large degree what makes conventional crossword puzzles attractive, in that some or all of the letters contained in one across or down word may be shared by another down or across words, respectively.

As seen in FIGS. 1 and 6, a crossword clue section 60 includes both across and down clues 61, 62, as is well-known.

As seen particularly in FIGS. 2 through 5, a circle-a-word region 70 is defined within the array. A preferred circle-a-word region includes a number of preprinted letters 80 and typically includes a region of intersection 110 with the interlocking crossword region 30. The preprinted letters 80 include circle-a-word preprinted letters 90 which are included in circle-a-word words, and also camouflage letters 120 which tend to hide the preprinted letters 90. The region of intersection 110 between the crossword region 30 and the circle-a-word region typically includes a number of circle-a-word spaces 111, which allow the player to manually write in a letter included in the circle-a-word word.

In an alternate version of the invention, the circle-a-word region is located entirely within the crossword region. As a result, in this version, some solution to the crossword region is required before any circle-a-word words may be located. An example of such a version of the invention is seen in FIG. 11, where the circle-a-word word "eel" is entirely located within the crossword region. In this version of the invention, the black square found in conventional crossword puzzles could be used.

The preprinted letters 80 include both circle-a-word preprinted letters 90 and circle-a-word camouflage letters 120. As seen in FIG. 2, the preprinted letters 80 are present when the puzzle is started. As seen in FIGS. 7 through 10, the number of preprinted letters 80 is typically less than the number of spaces 31 in across or down words.

For example, where the array 20 of a puzzle 10 is fifteen by fifteen, and therefore includes a total of 225 spaces, 30 to 50 spaces may typically be preprinted letters.

Figure 3:
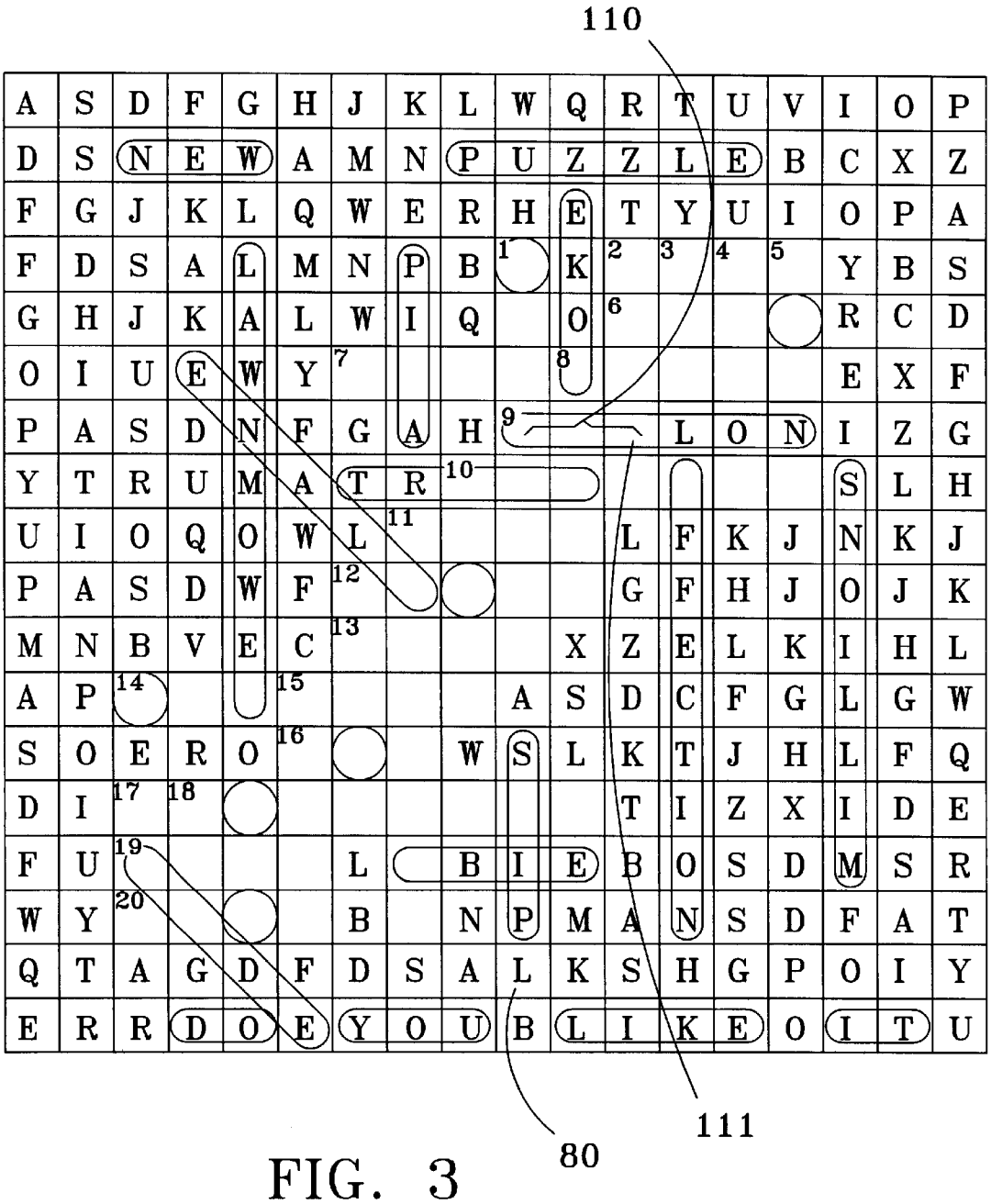
FIG. 3 is an enlarged view similar to that of FIG. 2, after the circle-a-word solution has been discovered.
Figure 4:
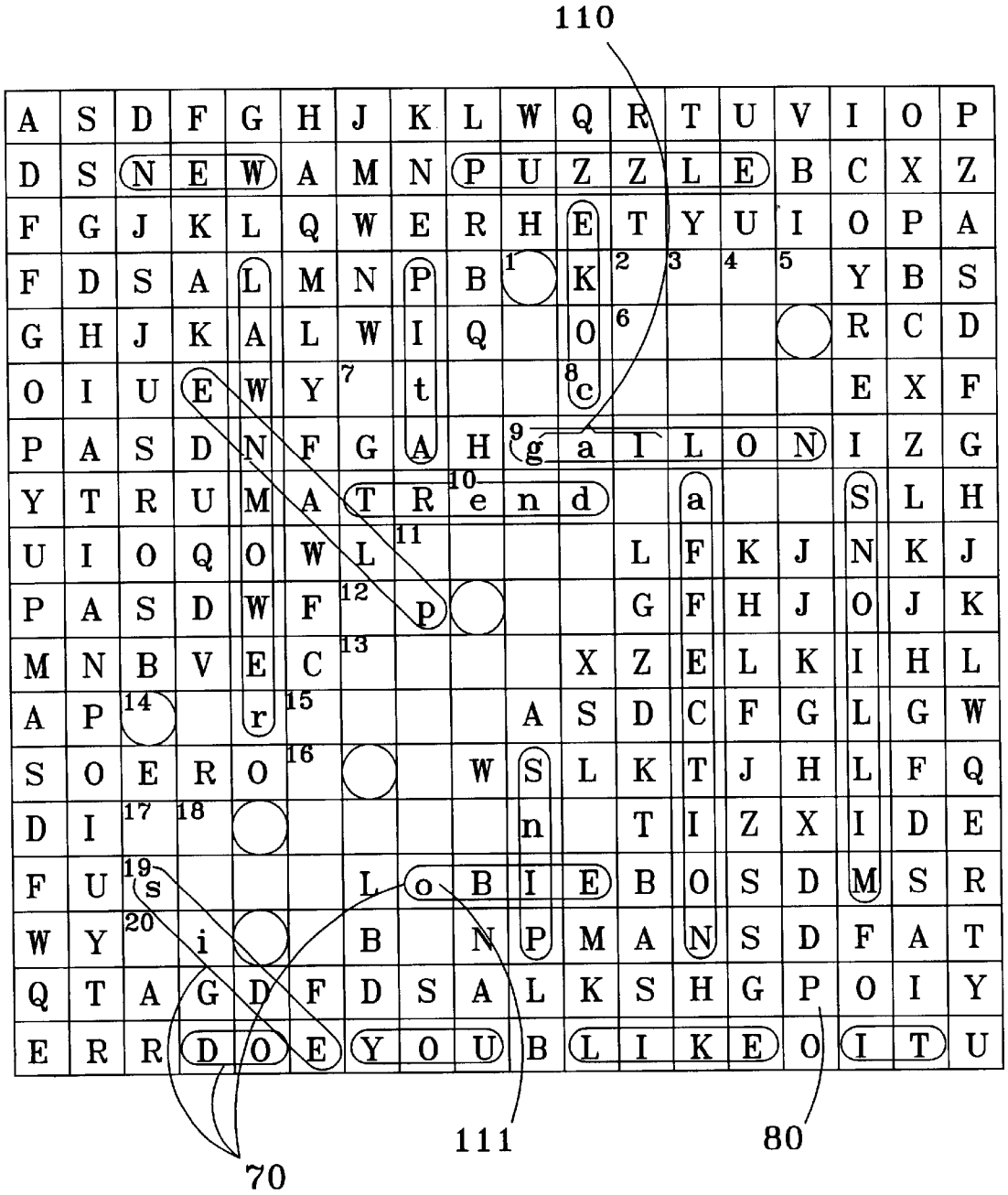
FIG. 4 is an enlarged view similar to that of FIG. 3, after the letters within the region of intersection between the interlocking crossword region and the circle-a-word region have been added by the player, in a lower case font which simulates handwriting.

Camouflage letters are not included in circle-a-word words. The puzzle is generally made more difficult by the fact that camouflage letters tend to make more difficult the determination of which of the preprinted letters are actually circle-a-word preprinted letters and are therefore part of circle-a-word words, and which of the preprinted letters are camouflage letters. As seen in FIGS. 3 or 4, after the circle-a-word words have been discovered, the entire top row of preprinted letters consists entirely of camouflage letters.

The relative quantities of circle-a-word preprinted letters and camouflage letters is variable. Either could be from 0% to 100% of the total of the preprinted letters. However, typically less than 50% of the preprinted letters are circle-a-word preprinted letters and more than 50% of the preprinted letters are camouflage letters.

The camouflage letters 120 tend to obscure and hide the letters 90 forming words 100. For example, as seen in FIG. 7, the camouflage letters capital "F" and capital "D" tend to camouflage the circle-a-word preprinted letter capital "H," which is used to form the circle-a-word word "hair." Due to the presence of the F and the D, the H does not stand out to the degree that it otherwise would.

Similarly, in FIG. 8 the camouflage letter capital "J" tends to hide the circle-a-word preprinted letters "F" and "L," which are used to form the circle-a-word word "flair." Due to the presence of the J, the F and L are somewhat more difficult for the eye to pick out.

In contrast, in FIG. 9, there are no camouflage letters present. Instead, the circle-a-word preprinted letters "R," "E" and "P" tend to stand out, allowing the player to more readily recognize and circle the circle-a-word "repair." As a result of having seen and recognized the "REP" as part of the word "repair," the player knows that the circle-a-word spaces 111 following the "REP" should be filled with "air." This knowledge helps to solve the puzzle.

There is generally a region of intersection 110 between the crossword region and circle-a-word region. Where there is a region of intersection, the region includes one or more circle-a-word spaces 111. The circle-a-word spaces, alone or in combination with the circle-a-word preprinted letters, form the circle-a-word words 100.

Adjacent circle-a-word preprinted letters 90 and circle-a-word spaces 111 form circle-a-word words 100. The sequence of circle-a-word preprinted letters 90 and circle-a-word spaces 111 forming the words 100 may be directed up, down, left, right, along the ascending diagonal or along the descending diagonal.

The circle-a-word words 100 may extend into the interlocking crossword region 30. In such a circumstance, the circle-a-word word 100 would include one or more circle-a-word spaces 111. For example, in FIG. 4, the circle-a-word word "plane" extends from the "p" located below the 11 and to the right of the 12 to the upper left. The "p" is therefore in a circle-a-word space 111. The "L," "A," "N" and "E" are all preprinted circle-a-word letters. The Alternatively, the circle-a-word words may be completely independent of the crossword region. As seen in FIG. 3, several circle-a-word words are contained in the lowest row of preprinted letters.

Circle-a-word preprinted letters 90 are typically a subset of the preprinted letters. That is, circle-a-word preprinted letters are included in circle-a-word words 100. Other preprinted letters, not included in circle-a-word words, are considered to be camouflage letters. Such camouflage letters tend to obscure how the circle-a-word preprinted letters can be used.

The circle-a-word spaces 111, collectively, comprise a region of intersection 110 between the interlocking crossword region 30 and the circle-a-word region 70.

For example, as seen in FIG. 3, a circle-a-word space 111 is ready to be filled, manually, with a circle-a-word letter. As seen in FIG. 4, the space 111 labeled in FIG. 3 has been manually filled with the letter "p." All such circle-a-word spaces, collectively, would form a region of intersection 110 between the circle-a-word region 70 and the interlocking crossword region 30.

As seen in FIGS. 1 and 6, a circle-a-word clue section 130 may optionally be provided to aid the player in searching for the circle-a-word words present in the circle-a-word region. The circle-a-word clue section includes a list of individual clue words 131 corresponding to the circle-a-word words present in the circle-a-word region.

Alternatively, the circle-a-word clue section may be done in crossword style. For example, where the circle-a-word is "down" the clue may be "the opposite of up." In this circumstance, there is some uncertainty by the player as to the identity of the word for which searched is being made.

In a still further alternative, no circle-a-word clue section is provided. In this circumstance, the player would simply scan the puzzle looking for circle-a-word words, rather than specific words indicated by the circle-a-word clue section.

Referring to FIG. 2, a number of unscramble-a-word spaces 140 is defined within the interlocking crossword region 30. Typically, at least three unscramble-a-word spaces are provided in each puzzle. However, five to ten spaces would typically be preferred. The unscramble a word space are distinguished from the other spaces 31 within the interlocking crossword region 30 by a circle 141 or other indicia.

Figure 5:
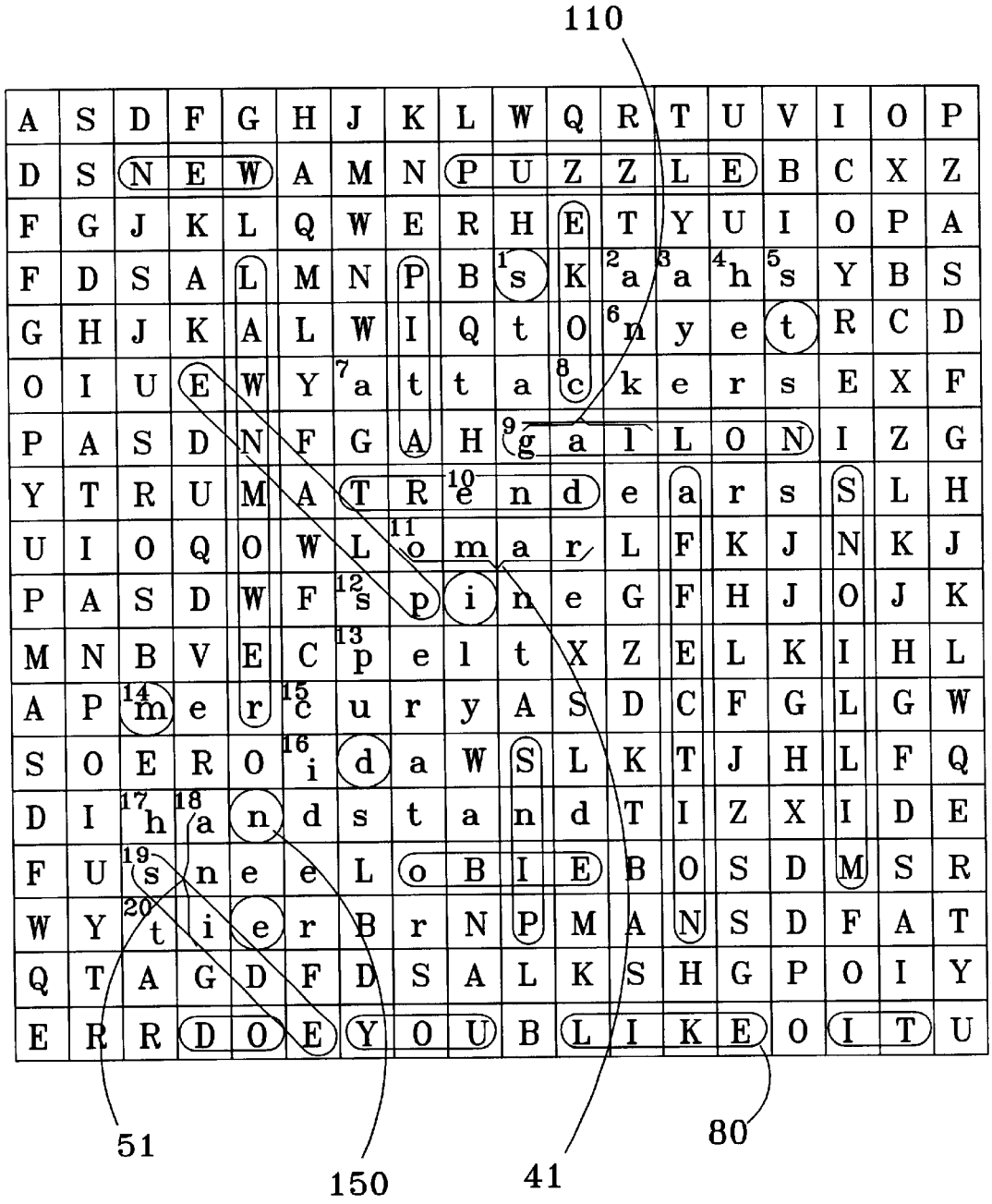
FIG. 5 is an enlarged view similar to that of FIG. 4, after the crossword solution has been discovered.

As seen in FIG. 5, during the course of the solution of the puzzle, the unscramble-a-word spaces become filled with unscramble-a-word letters 150. The correct letter 150 to put inside each unscramble-a-word space 140 is determined by the solution to the crossword region in view of the solution to the circle-a-word region.

When all of the unscramble-a-word letters 150 have been discovered, they are transferred to the unscramble-a-word starting area 170, with one letter on each underscore 171. The number of underscores 171 and the number of circles 141 is the same.

An unscramble-a-word clue 160 is similar to the crossword clues 60. The unscramble-a-word clue is typically a short phrase or sentence which suggests in vague terms the unscramble-a-word solution.

The unscramble-a-word solution 180 is a word or phase that results when the unscramble-a-word letters 150 are properly arranged. As seen in the example of FIG. 6, when the unscramble-a-word letters are "S," "T," "I," "M," "N," "D" and "E," the unscramble-a-word solution 180 is "MINDSET." This is because the above letters, when rearranged in a manner suggested by the unscramble-a-word clue 160 becomes the word MINDSET.

The preferred version of the invention provides the interlocking crossword region, the circle-a-word region and the unscramble-a-word spaces. However, an alternate version of the invention would include only the interlocking crossword region and the circle-a-word region.

The puzzle 10 may be made more or less difficult depending on the number of circle-a-word words 100 present. In general, increasing the size of the circle-a-word region and decreasing the size of the interlocking crossword region 30 tends to decrease the difficulty of the puzzle for a given array size. Likewise, decreasing the size of the circle-a-word region and increasing the size of the interlocking crossword region 30 tends to increase the difficulty of the puzzle.

For a circle-a-word region any given size, the puzzle may be made easier if a larger number of the preprinted letters are circle-a-word preprinted letters, and a smaller number of the preprinted letters are camouflage letters. A larger number of camouflage letters makes it more difficult for the player to find circle-a-word words.

A further method to regulate the level of difficulty involves varying the number of preprinted circle-a-word letters provided for a given circle-a-word. For example, as in FIG. 9 where a circle-a-word word has six letters and three of those letters are preprinted and three letters are within the interlocking crossword region, the circle-a-word word is relatively easily found. In contrast, as in FIG. 7 where one of the four letters of the circle-a-word word is preprinted and three letters are within the interlocking crossword region, the circle-a-word word is relatively more difficult to find.

Similarly, as seen by a comparison of FIGS. 9 and 10, the puzzle may be made harder by varying the percentage of circle-a-word spaces of a given circle-a-word word embedded within the crossword region. For example, as seen in both FIGS. 9 and 10, there are three circle-a-word preprinted letters (collectively "REP" and "DAN" , respectively). Recognition of "REP" as the first part of "repair" rewards the player with three letters, i.e. "air." However, recognition of "DAN" as the first three letters of the name "Dana" rewards the player with only one letter, i.e. "a."

Similarly, be comparing FIGS. 7 and 10, it can be seen that where only one circle-a-word preprinted letter is provided for a given circle-a-word word (as the "H" in FIG. 7) and the remainder of the word is embedded within the crossword region in the form of circle-a-word spaces 111 finding the circle-a-word word is somewhat difficult. However, as in FIG. 10, where the circle-a-word word includes three preprinted letters and only one circle-a-word space contained within the crossword region, the circle-a-word is more easily found.

A still further method of making the puzzle harder or easier results from selection of the location of the unscramble-a-word circles. For example, where an "E" is desired, the unscramble a word circle may be put where an "E" that is easily obtained is located, or the circle may be put in location where an "E" that is not so easily obtained is located. This is particularly important, since some players may not desire to completely solve the interlocking crossword region 30, but may instead solve that region only until the unscramble-a-word spaces 140 are solved. At that point, they may turn directly to the unscramble-a-word starting area 170.

Naturally, it is generally the case that increasing the array size tends to result in additional difficulty in the puzzle, since a larger array requires results in more words that must be discovered. Similarly, the use of more difficult and less common words also results in a more difficult puzzle.

As seen in FIG. 12, the array 20 and circle-a-word clue section 130 are illustrated. The crossword region 30 has not been filled out. A number of preprinted letters 80 are illustrated, including examples of both circle-a-word preprinted letters 90 which are contained within circle-a-word words 100 and circle-a-word camouflage letters 120 which are not contained within circle-a-word words.

As seen in FIG. 13, the array of FIG. 12 has been solved, including the filling in of the crossword region and the circling of the circle-a-word words. It should be noted that the circle-a-word words 100 extend into the crossword region 30. The degree to which circle-a-word words extend into the crossword region, by including one or more circle-a-word space 111, is the degree to which the crossword and circle-a-word regions intersect.

Several related strategies can be used to solve the version of the puzzle seen in FIG. 1. Typically, the player first looks for an easy across or down word to enable the filling-in of an across or down word spaces 40, 50. Generally, several such words will be apparent to the player. However, after some initial success, most players soon begin to experience difficulty. At this point, the player refers to the circle-a-word clue section 130 and begins to look for one or more clue words 131. When a circle-a-word word 100 is found, the word is circled. When the word comprises both circle-a-word preprinted letters 80 and also one or more circle-a-word spaces 111 defined within the region of intersection 110 between the circle-a-word region and the interlocking crossword region, then the circle-a-word spaces are filled in manually.

Each time the letter associated with a circle-a-word space 111 defined within the crossword region is discovered, the letter provides a clue to the solution of either an across or a down word 41, 51, or both, by filling in one or more letters in that across or down word. As a result, discovery of circle-a-word words, particularly where the word has one or more circle-a-word spaces 111 defined within the interlocking crossword region, is an aid in solving the puzzle.

It is typically the case that working alternately on both circle-a-word words and also on the across and down words 41, 51, the solution to the crossword region is completed. The letters from within the unscramble-a-word circles 141 are then transferred to the unscramble-a-word starting area 170 by writing them on the underscores 171. The unscramble-a-word clue is then examined. The player then attempts to rearrange the unscramble-a-word letters 150 to form the unscramble-a-word solution 180.

The previously described versions of the present invention have many advantages, including a primary advantage of providing a novel integrated crossword and circle-a-word puzzle that provides additional clues to puzzle enthusiasts who are not sufficiently skilled to solve crossword puzzles without the clues.

Another advantage of the present invention is to provide a novel integrated crossword and circle-a-word puzzle that has all the advantages of a crossword puzzle, and which can be operated in manner similar to a crossword puzzle by a person not desiring to take advantage of the multiple puzzles present.

Another advantage of the present invention is to provide a novel integrated crossword and circle-a-word puzzle that allows regulation of the level of difficulty by addition of a greater or lesser number of circle-a-word preprinted letters. A greater number of circle-a-word preprinted letters tends to result in a lesser number of across and down words within an interlocking crossword region and also results in a greater number of circle-a-word words providing clues to the crossword region. Both of these factors tend to make the puzzle easier to solve.

Another advantage of the present invention is to provide a novel integrated crossword and circle-a-word puzzle that allows regulation of the level of difficulty by a second means. By varying the degree to which individual circle-a-word words intersect the interlocking crossword region, the degree of difficulty can be varied. For example, where a circle-a-word word has six letters and five of those letters are preprinted and one letter is within the interlocking crossword region, the circle-a-word word is relatively easily found. In contrast, where only two of the six letters of the circle-a-word word are preprinted and four letters are within the interlocking crossword region, the circle-a-word word is relatively more difficult to find; however the value of such a word is greater, since the four letters within the interlocking crossword region add considerably to the solution of the puzzle.

A still further advantage of the present invention is to provide a novel integrated crossword and circle-a-word puzzle that additionally provides a plurality of unscramble-a-word spaces, which when the interlocking crossword region is completed contain unscramble-a-word letters that may be unscrambled into an unscramble-a-word solution.

Although the present invention has been described in considerable detail and with reference to certain preferred versions, other versions are possible. For example, it is clear that an infinite number of variations of the number and identity of circle-a-word preprinted letters, camouflage letters, circle-a-word spaces defined within the interlocking crossword region and other elements of the puzzle could be constructed. Similarly, the degree to which the crossword region and circle-a-word region intersect may be varied. That is, any given circle-a-word word may be mostly or fully defined by circle-a-word spaces 111 within the crossword region or the given circle-a-word word may be mostly defined in circle-a-word preprinted letters 90 and only partly defined in circle-a-word spaces 111. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A puzzle comprising:

(A) an array, including:

(a) an interlocking crossword region, defined within the array, having spaces for letters allowing the formation of across and down words; and (b) a circle-a-word region, defined within the array, replacing the black squares traditionally present in crossword puzzles; and (B) a crossword clue section.

2. The puzzle of claim 1, further comprising a region of intersection between the interlocking crossword region and the circle-a-word region, the region of intersection comprising a plurality of circle-a-word spaces, embedded within the interlocking crossword region, arranged to reduce the difficulty of a solution to the interlocking crossword region.

3. The puzzle of claim 1, further comprising a circle-a-word clue section.

4. The puzzle of claim 1, further comprising at least three unscramble-a-word spaces, defined among the interlocking spaces for across and down crossword words.

5. The puzzle of claim 3, further comprising an unscramble-a-word clue to aid in the solution of the unscramble-a-word.

6. The puzzle of claim 5, further comprising a circle-a-word clue section.

7. The puzzle of claim 3, further comprising unscramble-a-word spaces, defined among the interlocking spaces for across and down crossword words.

8. The puzzle of claim 7, further comprising an unscramble-a-word clue to aid in the solution of the unscramble-a-word.

9. A puzzle comprising:

(A) an array, including:

(a) an interlocking crossword region, defined within the array, having spaces for letters allowing the formation of across and down words;

(b) a circle-a-word region, defined within the array, replacing the black squares traditionally present in crossword puzzles, comprising:

(i) circle-a-word camouflage letters, distributed in spaces of the array not part of the interlocking crossword region; and (ii) circle-a-word solution letters distributed in spaces not part of the interlocking crossword region which are not filled by camouflage letters;

(c) a region of intersection between the interlocking crossword region and the circle-a-word region, the region of intersection comprising a plurality of circle-a-word spaces, embedded within the interlocking crossword region, arranged to reduce the difficulty of a solution to the interlocking crossword region; and (d) unscramble-a-word spaces, defined among the interlocking spaces for across and down crossword words;

(B) a list of crossword clues; and (C) a list of circle-a-word clues.

10. The puzzle of claim 9, additionally comprising an unscramble-a-word clue to aid in the solution of the unscramble-a-word.

* * * * *